US007007883B2

(12) United States Patent
Fairchild

(10) Patent No.: US 7,007,883 B2
(45) **Date of Patent: *Mar. 7, 2006**

(54) APPARATUS AND METHOD FOR DISPENSING ELONGATED MATERIAL

(75) Inventor: Michael A. Fairchild, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 23 days.

This patent is subject to a terminal disclaimer.

(21) Appl. No.: 10/359,521

(22) Filed: Feb. 5, 2003

(65) Prior Publication Data

US 2004/0149853 A1 Aug. 5, 2004

(51) Int. Cl.
*B65H 23/06* (2006.01)

(52) U.S. Cl. ..... 242/421.8; 242/421.9; 242/422.8

(58) Field of Classification Search ..... 242/421.8, 242/421.9, 422.8, 555, 555.3
See application file for complete search history.

(56) References Cited

U.S. PATENT DOCUMENTS

| | | | | | |
|---|---|---|---|---|---|
| 1,944,039 | A | * | 1/1934 | Frederick | 242/334.6 |
| 2,094,581 | A | * | 10/1937 | Clarkson et al. | 242/334.6 |
| 2,623,703 | A | | 12/1952 | Laycock | |
| 3,446,452 | A | * | 5/1969 | Tetens | 242/420.4 |
| 3,463,413 | A | * | 8/1969 | Smith | 242/417.2 |
| 3,688,999 | A | * | 9/1972 | Plattner et al. | 242/420.4 |
| 3,899,143 | A | * | 8/1975 | Slezak | 242/156.2 |
| 4,905,927 | A | * | 3/1990 | Lesse | 242/421.8 |
| 4,917,327 | A | | 4/1990 | Asbury, Jr. et al. | |
| 5,029,768 | A | | 7/1991 | Asbury, Jr. et al. | |
| 5,035,369 | A | * | 7/1991 | Beran et al. | 242/486.1 |
| 5,253,819 | A | * | 10/1993 | Butler, Jr. | 242/554.6 |
| 5,524,834 | A | * | 6/1996 | Bogucki-Land | 242/421.8 |
| 6,010,089 | A | * | 1/2000 | Winafeld et al. | 242/421.8 |
| 6,092,789 | A | | 7/2000 | Christopher et al. | |
| 6,540,170 | B1 | * | 4/2003 | Tipton et al. | 242/421.8 |

FOREIGN PATENT DOCUMENTS

GB 2185241 7/1987

OTHER PUBLICATIONS

Weiss, Herbert L., *Control Systems for Web-Fed Machinery, A Guide to the Design, Selection and Usage of Hydraulic, Pneumatic and Electronic Control Systems for Web-Fed Machinery*, pp. 78-80, 82, 94, 95, 98, 99, 103, 105, and 106 (1983).

* cited by examiner

*Primary Examiner*—Kathy Matecki
*Assistant Examiner*—Sang Kim
(74) *Attorney, Agent, or Firm*—Klarquist Sparkman, LLP

(57) ABSTRACT

Various embodiments of an apparatus and method for dispensing elongated material, such as tape, from a spool of such material are disclosed. In one embodiment, a dispenser includes a rotatable spindle for supporting a first spool of material and a feedback mechanism for providing a controlled braking force to the spindle in response to changes in tension in the material being dispensed. The dispenser also can include another spindle for supporting a second spool of material. The trailing end portion of material from the first spool can be spliced to the leading end portion of material from the second spool to provide a continuous feed of material between the spools.

19 Claims, 7 Drawing Sheets

APPARATUS AND METHOD FOR DISPENSING ELONGATED MATERIAL

FIELD

The present invention relates to embodiments of an apparatus and method for dispensing elongated material, such as tape, from a roll of the material.

BACKGROUND

Modern consumer and industrial packaging often includes reinforcing tapes or tear tapes as part of their construction. Various tape dispensers have been devised to dispense such tapes into corrugator and packaging equipment.

One such dispenser in disclosed in U.S. Pat. No. 4,914,327 to Asbury et al. The '327 application discloses a system for automatically splicing together the trailing end portion of a spool, or roll, of tape to the leading end portion of a new spool of tape without interrupting the dispensing process. To prevent the tape from breaking under the strain caused by the inertia of the new spool of tape (which is initially at rest), the tape path is provided with a tension-control mechanism. In response to an increase in tension in the tape, the tension-control mechanism moves to shorten the length of the tape path, thereby relieving the increased tension in the tape. As the new spool comes up to speed, the tension-control mechanism, under the influence of a biasing mechanism, returns to its initial position to increase the path of the tape length. An active brake assembly prevents the new spool from unduly accelerating in response to the lengthening of the tape path by the tension-control mechanism.

Despite the previous systems, there is a continuing need for new and improved systems for dispensing tape. For example, the productivity of downstream equipment (e.g., corrugator and packaging equipment) that receives tape from a dispensing system depends in part on the rate at which the dispensing system can dispense the tape. Hence, there is a particular need for dispensing systems that allows for splicing at dispensing rates greater than heretofore possible.

SUMMARY

The present invention is directed to various embodiments of an apparatus and method for dispensing elongated material, such as tape, from a spool of such material.

According to one representative embodiment, an apparatus for dispensing elongated material from a roll of material includes at least one spindle for supporting the roll of material and a brake for applying a braking force to the spindle. A movable guide member defines a portion of the path the elongated material is to follow by moving in response to increased tension in the material to shorten the path of the material and by moving in response to decreased tension in the material to lengthen the path of the material. An elongated biasing member is coupled at one end to the guide member, and also is movably coupled to a mechanical linkage, such as a pivoted lever, which in turn is operatively connected to the brake.

The guide member, biasing member, mechanical linkage, and brake cooperate in a feedback system to provide a controlled braking force to the spindle in response to changes in tension in the material being dispensed. For example, when the guide member moves to shorten the path length in response to an increase in tension, the brake automatically reduces the braking force to permit acceleration of the spindle. Conversely, when the guide member moves to lengthen the path length in response to a decrease in tension, the brake automatically increases the braking force to retard rotation of the spindle.

In particular embodiments, a pulley is mounted on the mechanical linkage and the biasing member is reeved around the pulley. In this manner, the pulley serves as a force multiplier by increasing the force that is transferred to the mechanical linkage through the biasing member. The mechanical advantage provided by the pulley arrangement allows for the use of braking torques that prevent a spool from unduly accelerating at dispensing rates greater than 900 feet per minute.

In an illustrated embodiment, the guide member is mounted for movement on a rail. The guide member also has a pulley, or roller, around which the material is reeved. Thus, an increase in tension in the material causes movement of the guide member along the rail in a first direction against the bias of the biasing member. When there is a decrease in tension, the guide member is caused to move in a second direction along the rail under the influence of the biasing member.

According to another representative embodiment, an apparatus is provided for dispensing elongated material from a roll of material supported on a rotatable spindle. A tension-control mechanism for defining the path of the material being dispensed is movable in a first direction in response to an increase in tension in the material being dispensed. An elongated elastic member is reeved around a pulley and has a first end coupled to the tension-control mechanism and a second end secured at a position spaced from the pulley. The elastic member provides a biasing force for urging the tension-control mechanism in a second direction, which can be directly opposite the first direction, whenever there is a decrease in tension in the material being dispensed.

According to yet another representative embodiment, an apparatus allows for splicing the trailing end portion of an elongated material from a first roll to the leading end portion of an elongated material from a second roll to provide a continuous feed of material between the rolls. The apparatus includes a first rotatable spindle for supporting the first roll of material and a second rotatable spindle for supporting the second roll of material. A feedback mechanism is configured to prevent slack from forming in the second roll of material following splicing as material from the second roll is being dispensed at a rate of at least 900 feet per minute. In particular embodiments, the feedback mechanism comprises a brake mechanism for applying a braking torque to the first and second spindles, a mechanical linkage coupled to the brake mechanism, a tension-control mechanism operable to move in response to changes in tension in the material being dispensed, and a biasing element coupling the tension-control mechanism to the mechanical linkage. The brake mechanism, mechanical linkage, tension-control mechanism, and biasing element cooperate to provide a controlled braking torque in response to changes in tension in the material.

Methods for dispensing elongated material, such as tape, from a roll also are disclosed. In one embodiment, for example, material is dispensed from a first spool of material at a rate of at least 900 feet per minute. When the first spool is nearly depleted, the trailing end portion of the material from the first spool is spliced to the leading end portion of material from a second spool without decreasing the rate at which material is being dispensed. Following the splicing operation, material is dispensed from the second spool at a rate of at least 900 feet per minute.

In another embodiment, a method for dispensing material comprises applying a quiescent braking torque of at least 30 in-lbs to a rotatable spindle supporting a first spool of the material and removing at least a portion of the braking torque to allow material to be dispensed from the first spool. When the first spool is nearly depleted of material, the trailing end portion of the material from the first spool is spliced to the leading end portion of material from a second spool. Following splicing, material is dispensed from the second spool. In particular embodiments, material is dispensed from the first and second spools at a rate of at least 900 feet per minute.

The foregoing and other features and advantages of the invention will become more apparent from the following detailed description of several embodiments, which proceeds with reference to the accompanying figures.

BRIEF DESCRIPTION ON THE DRAWINGS

DETAILED DESCRIPTION

Figure 1:
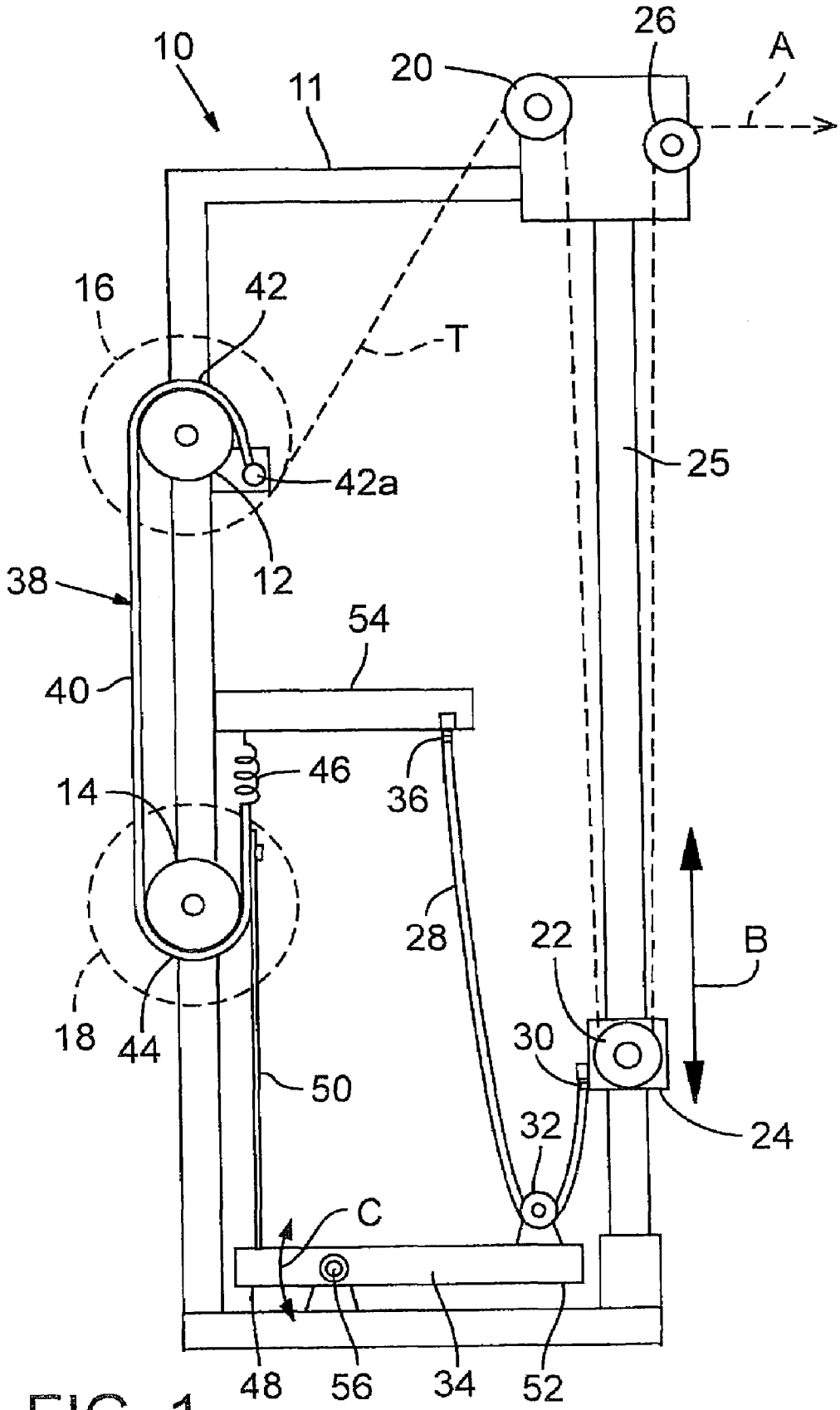
FIG. 1 is a schematic illustration of a dispensing apparatus according to one embodiment.

Referring to FIG. 1, there is shown a schematic illustration of a dispensing apparatus, indicated generally at 10, for dispensing elongated material from a roll, or spool, of the material. The embodiments of dispensing apparatus disclosed herein are preferably, but not exclusively, used for dispensing tape. Accordingly, the embodiments of dispensing apparatus disclosed herein can be used to dispense other types of elongated material from rolls, such as, paper, rope, fabric, or string, to name a few.

Apparatus 10 in the illustrated embodiment includes a frame 11. Mounted on the frame 11 for rotational movement are a first spindle 12 and a second spindle 14. The first spindle 12 supports a first spool of tape 16 and the second spindle 14 supports a second spool of tape 18. Tape T from one of the first and second spools 16, 18 is routed over a fixed roller 20, down to a tensioning roller 22 of a tension-control mechanism 24, and over a fixed roller 26, and then is fed to downstream equipment (e.g., corrugator or packaging equipment), as indicated by arrow A.

In the illustrated embodiment, apparatus 10 is shown dispensing tape from the first spool 16. When the tape from the first spool 16 is depleted, the trailing end portion of the tape from the first spool 16 can be spliced to the leading end portion of the tape from the second spool 18 to provide a continuous feed of tape. While tape is being dispensed from the second spool 18, another full spool of tape can be loaded onto the first spindle 12. The leading end portion of the tape from the new spool can then be spliced to the trailing end portion of tape from the second spool 18. This process can be repeated as necessary with any number of spools.

Any suitable splicing technique can be implemented in the embodiments of dispensing apparatus described herein to splice the trailing end portion of one spool of tape to the leading end portion of a succeeding spool of tape. For example, the automatic splicing technique described in the previously mentioned '327 patent to Asbury, which is incorporated herein by reference, can be used for splicing. As used herein, the phrase "automatic splicing" or "automatically splicing" refers to splicing operations in which the trailing end portion of a first spool is caused to splice to the leading end portion of a second spool while substantially maintaining the rate at which tape is supplied to downstream equipment.

The tension-control mechanism 24 (also referred to herein as a guide member in other embodiments) is movable in two directions (upwardly and downwardly, as indicated by double-headed arrow B, in the illustrated embodiment) along an upright rail 25 to vary the path length of the tape in response to changes in tension in the tape. The tension-control mechanism 24 is pulled downwardly by an elongated biasing member 28 and upwardly by the tension in the tape. Thus, when tape tension is high (i.e., when the current spool is providing tape slower than is required by downstream equipment, such as at the beginning of a spool), the tension-control mechanism is elevated. The upward movement of the tension-control mechanism 24 shortens the tape path so that tape can be fed to downstream equipment without requiring the spool to dispense a corresponding length contemporaneously. Conversely, when tape tension is low (i.e., when the current spool is providing tape faster than is required by downstream equipment), the biasing member 28 causes the tension-control mechanism 24 to assume a lower position (as shown in FIG. 1) to increase the length of the tape path.

In particular embodiments, the biasing member 28 is a piece of elastic material, such as an elastic hose (e.g., surgical tubing), although other elastic materials can be used, such as an elastic band or equivalent devices. The illustrated biasing member 28 is reeved around a pulley 32 of a pivoted lever 34, and has a first end 30 connected to the tension-control member 24 and a second end 36 secured to an extension 54 of frame 11. Lever 34 is mounted for pivoting movement about a pivot pin 56, as indicated by double-headed arrow C.

A brake assembly 38 applies a controlled braking force to the first and second spindles 12, 14, respectively. The brake assembly 38 in the illustrated configuration includes a brake band 40 that extends about portions of spindles 12, 14 and serves to retard their rotation. An upper end portion 42 of the band 40 is affixed to frame, as at 42*a*, and therefore is stationary. A lower end portion 44 of the band 40 is coupled to extension 54 of frame 11 by a spring 46. Spring 46 exerts a biasing force on band 40 that causes the band to apply a quiescent braking force to the spindles 12, 14. In the illustrated embodiment, for example, the spring 46 is a tension spring and is operable to pull upwardly on the lower end portion 44 of band 40 to cause the band 40 to tighten around spindles 12, 14. In alternative embodiments, such as the embodiment of FIGS. 2-7 described below), a compression spring can be used to apply a braking force to the spindles. In addition, biasing mechanism other than springs can be used to tension the brake band around the spindles. Such biasing mechanism can include, for example, a piece of elastic material, such as an elastic band or hose, or any of various other elastic or resilient articles.

The lower end portion 44 of band 40 is coupled to a first end portion 48 of the lever 34 by a connecting member 50. The brake assembly 38, lever 34, tension-control mechanism 24, and biasing member 28 cooperate to form a feedback mechanism, by which the brake assembly 38 applies a controlled braking force in response to changes in the tension in the tape. More specifically, when tape tension is high, the tension-control mechanism 24 travels upwardly, which in turn causes a second end 52 of the lever 34 to move upwardly and the first end 48 of the lever 34 to move downwardly. This movement is coupled to the brake assembly 38 by connecting member 50, which pulls against the spring 46, thereby reducing tension in the brake band 40 and causing a decrease in braking force so that the dispensing of tape can be accelerated. Conversely, when tape tension is lowered, the tension-control mechanism 24 travels downwardly under the biasing force of biasing member 28, which in turn allows the first end 48 of the lever 34 to move upwardly. This motion permits the spring 46 to reapply more tensioning force to the brake band 40, thereby causing a corresponding increase in the braking force to reduce the rate at which tape is being dispensed.

When the first spool 12 becomes depleted of tape, splicing the trailing end of the tape from the first spool 12 to the leading end of the tape from the second spool 14 will automatically bring the second spool 14 into action. The feedback mechanism serves to control the braking force in response to tension spikes that can occur during and immediately following splicing. For example, since the second spool 14 cannot immediately supply tape at the rate required by downstream equipment (due to the inertia of the second spool 14), the tension in the tape suddenly increases. The increased tension causes the tension-control mechanism 24 to move upwardly, which in turn causes the brake assembly 38 to reduce the braking force to allow rotation of the second spool 18. Also, the upward movement of the tension-control mechanism 24 shortens the tape path, thereby providing tape to the downstream equipment without requiring the second spool 14 to dispense a corresponding length contemporaneously.

As the second spool 18 accelerates to the required speed, the tension in the tape decreases, thereby allowing the tension-control mechanism 24 to be pulled downwardly by the biasing member 28. This movement activates the brake band 40, which applies a gradually increasing braking force on the second spindle 14 in response to the decrease in tape tension until equilibrium is established.

As a spool is dispensing tape, the diameter of the tape on the spool decreases. The feedback mechanism provided by the brake assembly 38, lever 34, tension-control mechanism 24, and biasing mechanism 28 compensates for the diametrical change of the spool by gradually decreasing the braking force to ensure substantially uniform tension throughout an entire roll. Without such a feedback system, the tension in the tape would increase in proportion to the change in radius of the spool from which the tape is dispensed.

If, following a splicing operation, the second spool 18 accelerates beyond the rate at which tape is being pulled by the downstream equipment, slack can form in the second spool 18. The slack can become stuck to the spool, entangled with the tape path, and/or cause tape breakage, which then requires a stoppage in production to fix the problem. This phenomenon is known as "overrun." Thus, to prevent such overrun of the second spool following a splice, the brake band must provide a braking torque sufficient to prevent the second spool 18 from accelerating beyond the rate at which tape is being pulled by the downstream equipment. It can be appreciated that increasing the rate at which tape is dispensed requires a corresponding increase in available braking torque to prevent over-acceleration of a spool following a splicing operation.

However, if the braking torque on a spindle is too high, the upward pulling force of the tension-control mechanism 24 (caused by an increase in tension) may not be sufficient to overcome the spring 46 to permit the spindle to accelerate to the required speed. Hence, the braking torque desirably should be great enough to prevent over-acceleration at a desired dispensing rate without adversely affecting the ability of the system to overcome the biasing mechanism (e.g., spring 46) that retards rotation of the spindles.

In the system disclosed in the '327 patent to Asbury, a maximum braking torque of about 21 in-lbs. typically is applied to the spindles, which is sufficient to permit splicing at dispensing rates of about 600 to 800 feet per minute while preventing overrun from occurring after a splicing.

The embodiments of dispensing apparatus described herein allow for splicing at greater dispensing rates than prior systems. In particular embodiments, the brake band (e.g., brake band 40) is configured to apply a maximum braking torque of about 30 to 100 in-lbs., with 40 in-lbs. being a specific example. Embodiments having a braking torque of up to 100 in-lbs. have been found to permit splicing at dispensing rates up to about 1500 feet per minute. The ability to provide an increased braking torque is a consequence of coupling the biasing member 28 to the lever 34 via the pulley 32. More specifically, biasing member 28 pulls upwardly on the second end 52 of lever 34 when the tension-control mechanism 24 is pulled upwardly in response to an increase in tape tension. Since biasing member 28 is reeved around pulley 32, the pulling force of biasing member 28 on the lever 34 is greater than the upward pulling force that the tape exerts on the tension-control mechanism 24. In this manner, pulley 32 serves as a force multiplier for increasing the force (by about a factor of two) that is transferred to the lever 34 from the tension-control mechanism 24 by the biasing member 28. Hence, the mechanical advantage provided by the pulley 32 can be used to compensate for an increase in braking torque over prior systems.

Figure 2:
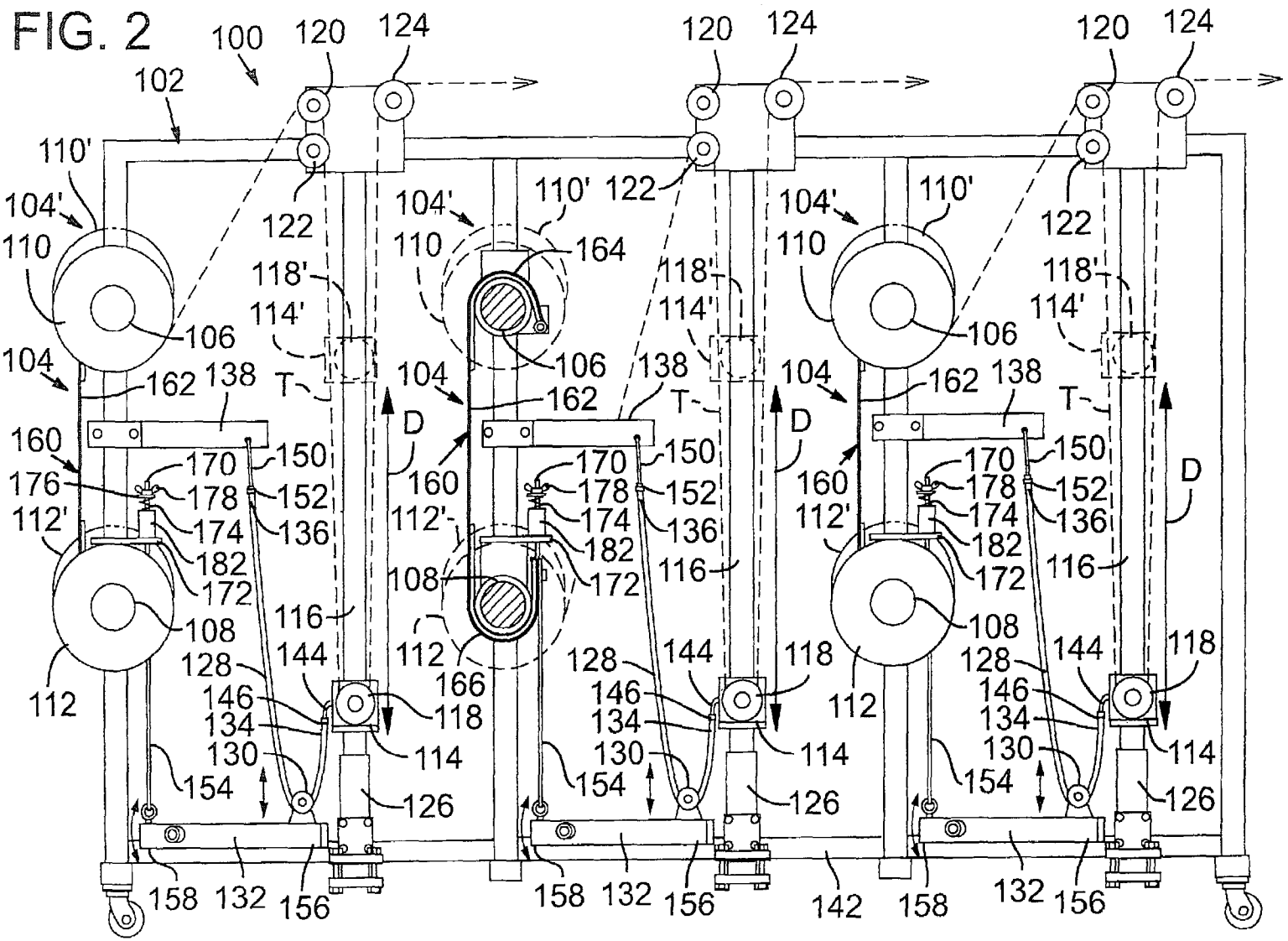
FIG. 2 is a side elevation view of a dispensing apparatus, according to one embodiment, for dispensing tape from multiple dispensers.
Figure 4:
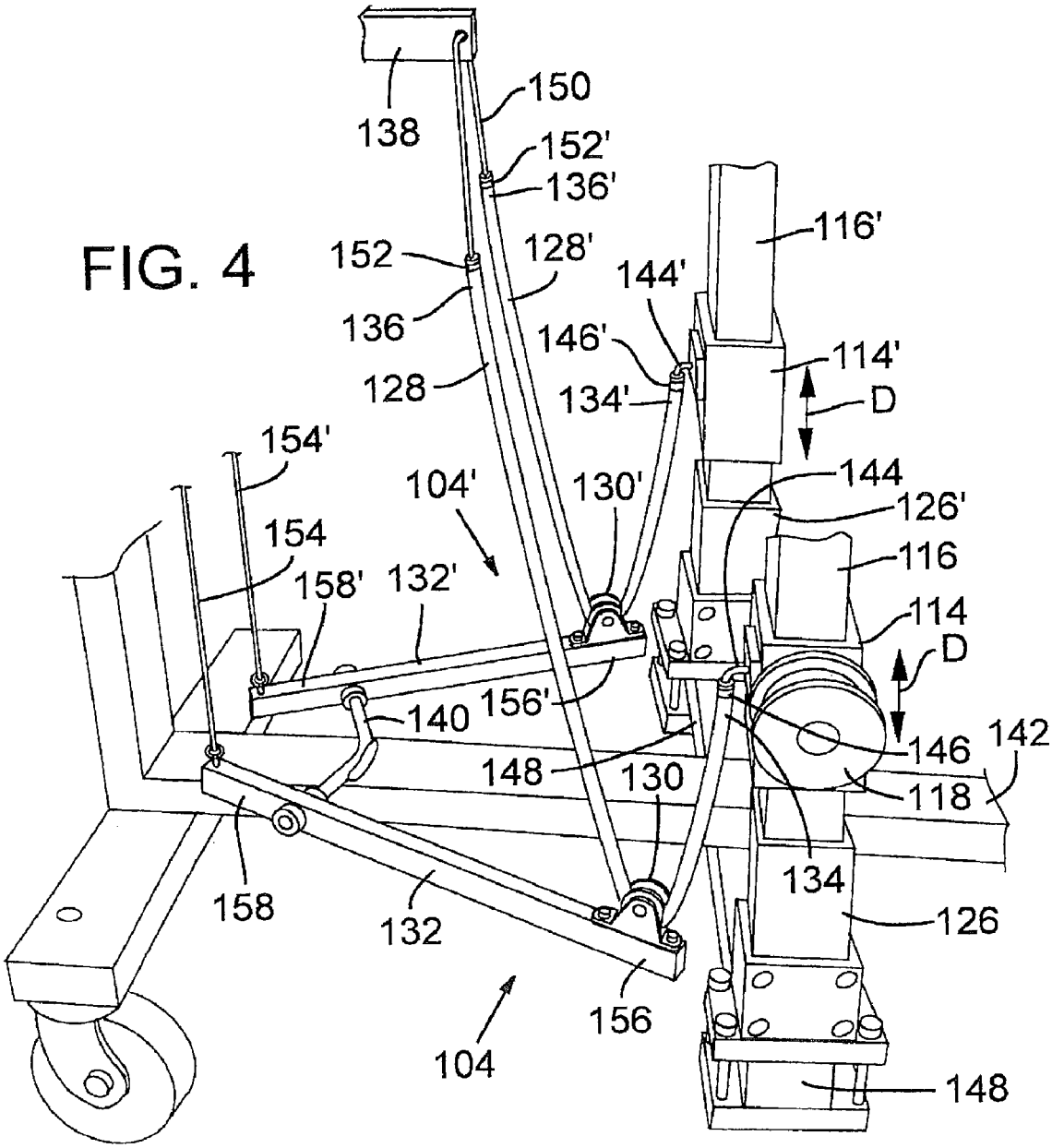
FIG. 4 is a partial, perspective view of the bottom portion of two side-by-side dispensers of the apparatus of FIG. 2, as viewed from above.
Figure 5:
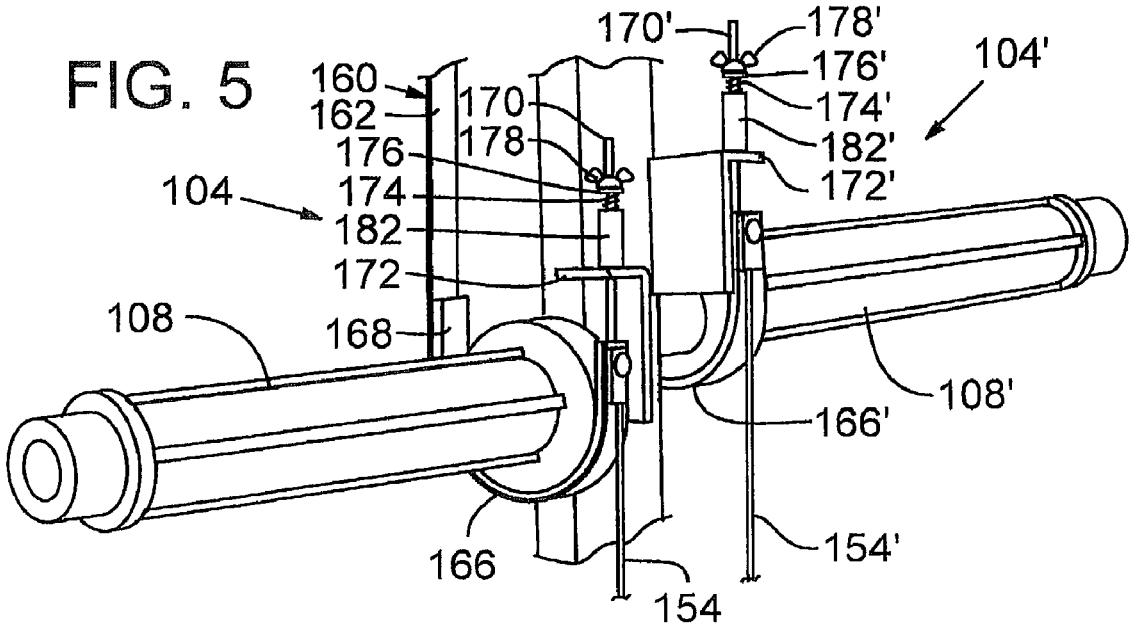
FIG. 5 is a partial, perspective view of a portion of two side-by-side dispensers of the apparatus of FIG. 2, illustrating the lower spindles and the lower portion of the brake assemblies of the dispensers.
Figure 6:
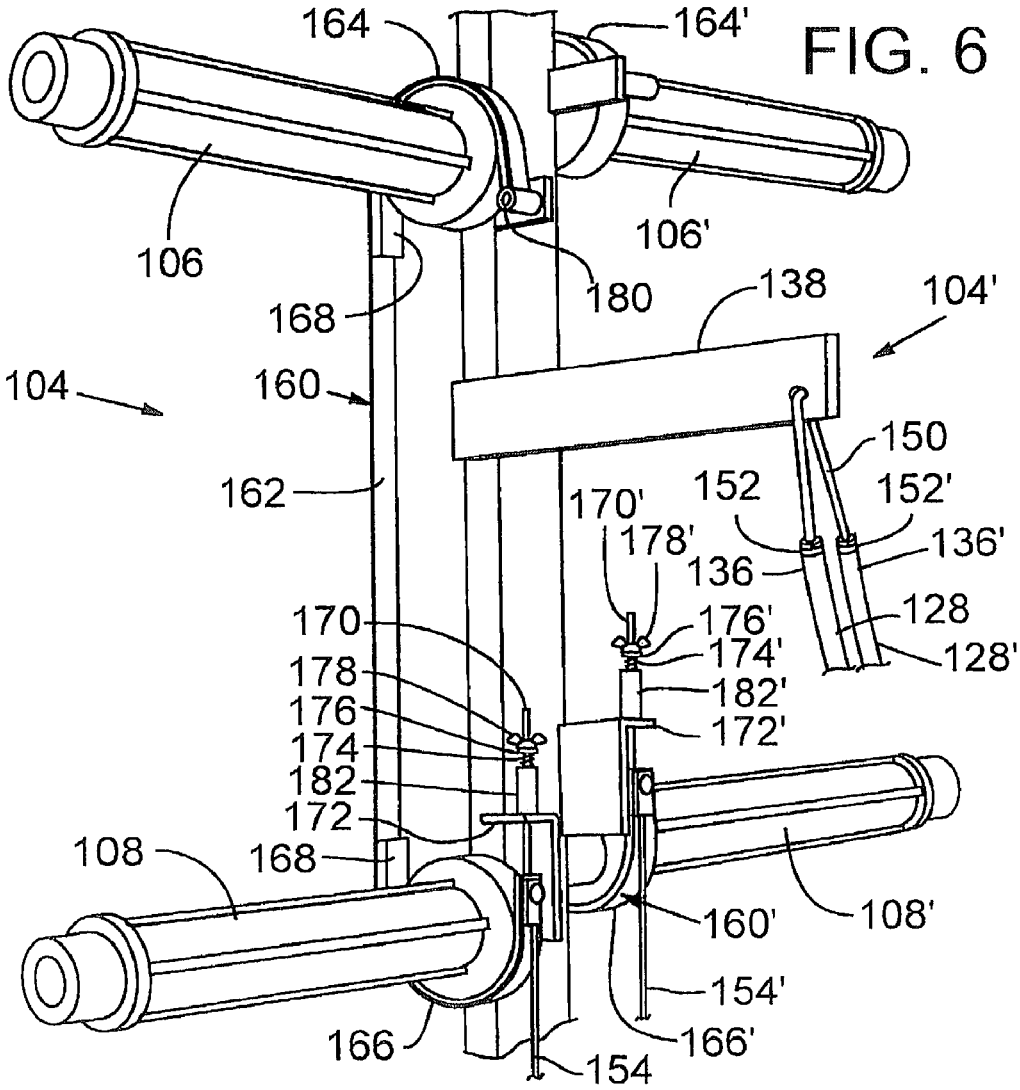
FIG. 6 is a partial, perspective view similar to FIG. 5, illustrating the upper and lower spindles and the brake assemblies of two side-by-side dispensers.

Referring now to FIG. 2, there is shown an apparatus 100 according to one embodiment for simultaneously dispensing tape from multiple rolls. Apparatus 100 includes a frame 102 on which there are mounted six tape dispensers constructed similarly to apparatus 10 shown schematically in FIG. 1. In the illustrated configuration, three such dispensers, indicated at 104, are mounted on one side of the frame 102, and three dispensers, indicated at 104', are mounted on the opposite side of frame 102 (which are generally hidden from view in FIG. 1). In alternative embodiments, apparatus 100 can have any number of dispensers 104, 104'. As best illustrated in FIGS. 4–6, each dispenser 104 is mounted in a side-by-side relationship with an adjacent dispenser 104'.

Components of dispensers 104' that are identical to corresponding components of dispensers 104 are given the same respective reference numerals, except that the reference numerals for the components of dispensers 104' are followed by an apostrophe ('). As shown in FIGS. 2, 3, 5 and 6 each dispenser 104 includes first and second rotatable spindles 106, 108, respectively, mounted to the frame 102.

The first spindle 106 supports a first spool of tape 110 and the second spindle 108 supports a second spool of tape 112. Dispensers 104' have respective first and second spindles 106', 108' for supporting respective first and second spools 110', 112' on the opposite side of frame 102.

Each dispenser 104, 104' also includes a respective tension-control mechanism 114, 114' that ride on respective upright rails 116, 116' extending between the top and bottom portions of the frame 102. As shown in FIG. 4, each rail 116 of a dispenser 104 and rail 116' of an adjacent dispenser 104' are mounted on opposite ends of a transverse member 148 of frame 102. Tension-control mechanisms 114, 114' are movable upwardly and downwardly along their respective rails 116, 116', as indicated by double-headed arrow D in FIGS. 2–4. Each tension-control mechanism 114, 114' includes a respective tensioning roller 118, 118'.

Figure 3:
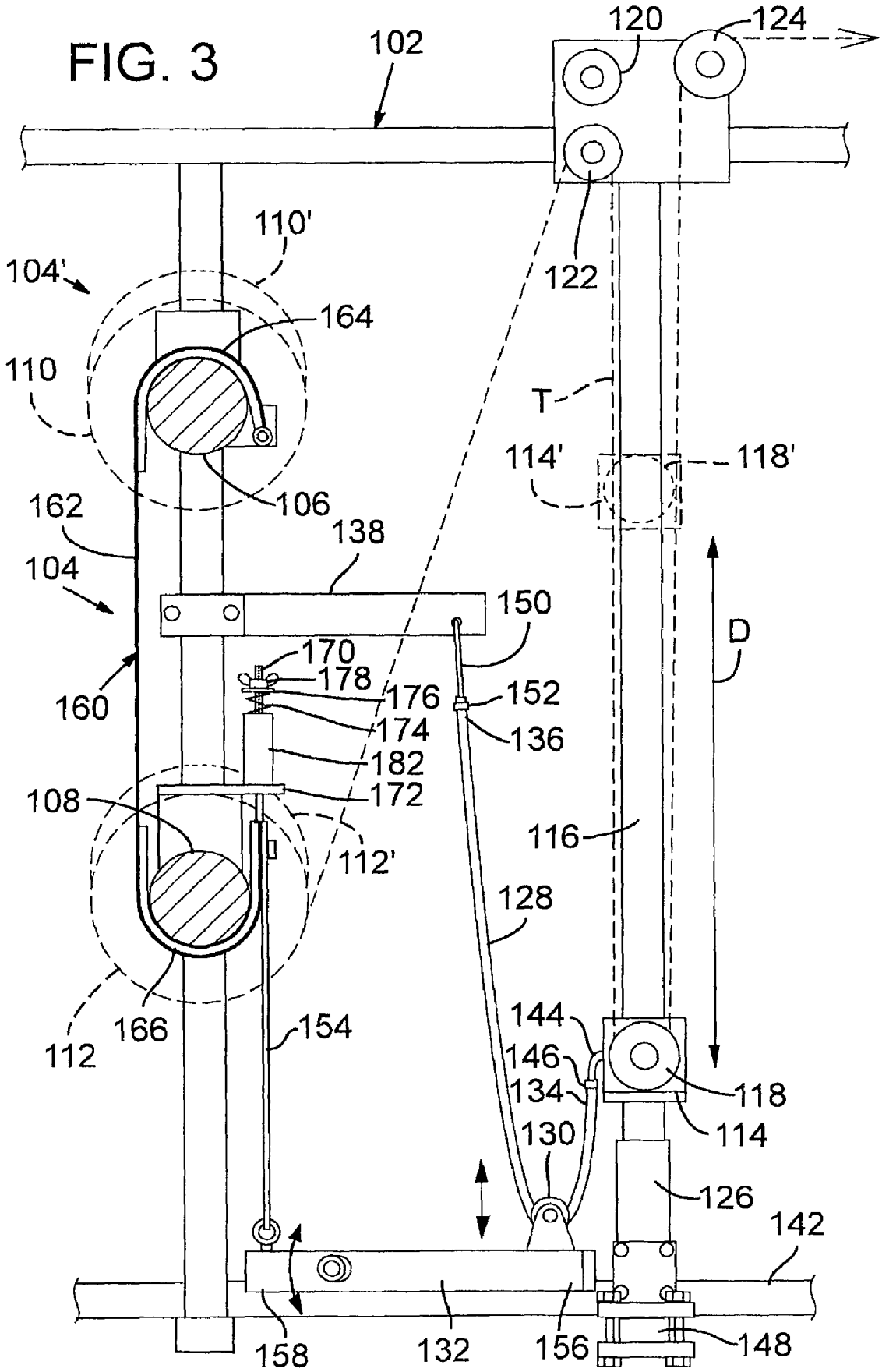
FIG. 3 is an enlarged side elavation view of one of the dispensers of the apparatus of FIG. 2.

As shown in FIGS. 2 and 3, tape that is dispensed from the first spool 110 of a dispenser 104 (e.g., the far left and far right dispensers 104 in FIG. 2) is routed over a respective fixed roller 120, down to a tensioning roller 118 of a respective tension-control mechanism 114, and over a respective fixed roller 124 to define a tape path T. Tape that is dispensed from the second spool 112 of a dispenser 104 (e.g., the center dispenser 104 in FIG. 2) can be routed over a respective fixed roller 122 mounted directly below fixed roller 120. Tape from the first spools 110 can be spliced to tape from respective second spools 112 to provide a continuous feed of tape from each dispenser 104. Although not shown, tape from each dispenser 104' can be reeved in the same manner over a respective tensioning roller 118' and a set of fixed rollers (not shown).

As best shown in FIG. 4, each rail 116, 116' in the illustrated configuration is elongated tubing having a square cross-section, although rails having other cross-sectional shapes also can be used. Stops 126, 126' (which can be a piece of rigid tubing) can be placed at the bottom of rails 116, 116' to limit the downward travel of tension-control mechanisms 114, 114'. Elastic biasing members 128, 128' (which can be elastic hose or tubing, such as surgical tubing) provide biasing forces for biasing tension-control mechanism 114, 114' downwardly against the tension in the tape. Biasing members 128, 128' have first ends 134, 134' coupled to tension-control members 114, 114' and second ends 136, 136' coupled to an extension 138 of frame 102, and are reeved around respective pulleys 130, 130'.

Biasing members 128, 128' can be coupled to tension-control members 114, 114', respectively, and to extension 138 in any suitable manner. As shown in FIG. 4, for example, the first ends 134, 134' of biasing members 128, 128' are placed on male inserts 144, 144' and secured with hose clamps 146, 146'. Second ends 136, 136' of biasing members 128, 128' are secured with hose clamps 152, 152' to opposite ends of a generally U-shaped rod 150 that extends through extension 138. Rod 150 can be one piece or two separate pieces connected to each other at their ends.

As shown in FIG. 4, pulleys 130, 130' are mounted on first end portions 156, 156' of respective pivoted levers 132, 132'. Each lever 132 of a dispenser 104 and lever 132' of an adjacent dispenser 104' are pivotally mounted on opposite ends of a common pivot pin 140. Pivot pin 140 is mounted to a longitudinal member 142 of frame 102 extending between the dispensers 104 and 104'. Lever 132 and lever 132' are configured to pivot independently relative to each other about pivot pin 140.

Figure 7:
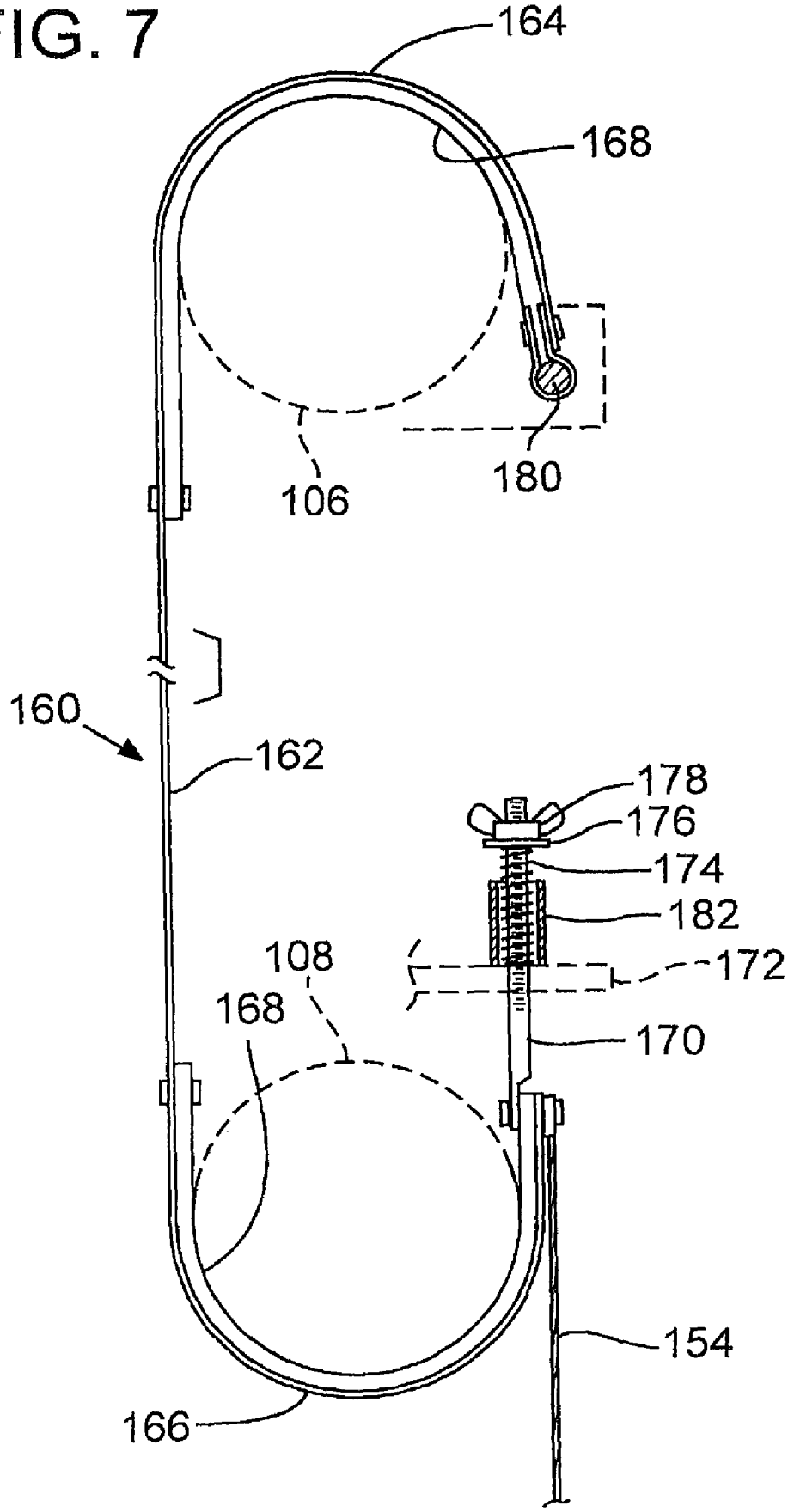
FIG. 7 is an enlarged view of a brake assembly used in the apparatus of FIG. 2.

As shown in FIG. 2, each dispenser 104 has a brake assembly 160 operatively connected to a respective biasing member 128 to provide a controlled braking force to spindles 106, 108 in response to changes in tension in the tape. As best shown in FIGS. 6 and 7, each brake assembly 160 in the illustrated embodiment includes a brake band 162 having an upper end portion 164 that extends about a portion of a respective first spindle 106 and a lower end portion 166 that extends about a portion of a respective second spindle 108. The upper end portion 164 of brake band 162 is affixed to frame 102 with a bolt 180. The inner surfaces of upper end portion 164 and lower end portion 166 may be lined with a suitable brake lining material 168 (e.g., Scan-Pac 232 AF, available from Scan-Pac Manufacturing of Mequon, Wis.) for contacting the surfaces of spindles 106, 108.

As best shown in FIG. 7, a threaded rod 170 is connected to lower end portion 166 of brake band 162 and extends upwardly through a bracket 172 on frame 102. A compression spring 174 is disposed around rod 170 and supported by bracket 172. A washer 176 and a nut 178 on rod 170 are tightened against the spring 174 to preload, or pre-compress, the spring. As can be appreciated by FIG. 7, pre-compression of spring 174 causes the spring to exert a biasing torque that pulls upwardly on the lower end portion 166 of brake band 162, which in turn applies a braking torque to spindles 106, 108. In particular embodiments, the brake band applies a maximum braking torque of at least 30 in-lbs. to spools 106, 108. A downward pulling force on rod 170 compresses spring 174 to relieve tension in the brake band 162, thereby reducing the braking torque on spindles 106, 108.

In use, tension spikes, which can occur following splicing, can transfer excessive forces to the spring 174, causing damage or failure of the spring due to over-actuation. A stop mechanism may be provided to prevent such over-actuation of the spring. As shown in FIG. 7, for example, a rigid sleeve 182 is disposed on rod 170 between bracket 172 and washer 176. Compression of the spring 174 therefore is limited to the distance between the washer 176 and the adjacent end of the sleeve 182. In this manner, sleeve 182 and washer 176 serve as a stop mechanism to prevent over-actuation of the spring 174.

Each dispenser 104' has a similarly configured brake assembly, which is shown partially in FIG. 6, for applying a braking force to respective spindles 106', 108'.

As shown in FIG. 4, connecting members 154, 154' are connected at their lower ends to the second end portions 158, 158' of levers 132, 132'. As shown in FIGS. 5–7, connecting members 154, 154' are connected at their upper ends to the lower end portions 166, 166' of brake bands 162, 162'. In working embodiments, connecting members 154 may be steel wires.

Dispensers 104, 104' operate in a manner similar to the embodiment shown in FIG. 1. For example, an increase in tape tension causes the end portion 158 of a lever 132 to pivot downwardly, which causes connecting member 154 to pull downwardly on the lower end portion 166 of a respective brake band 160 against spring 174. This movement reduces tension in the brake band to cause a reduction in braking force applied to spindles 106, 108. Conversely, a decrease in tape tension permits end portion 158 of lever 132 to pivot upwardly to allow spring 174 expand, thereby resulting in an increase in braking force applied to the spindles 106, 108. Hence, tension-control mechanism 114, elastic member 128, and brake assembly 160 cooperate to form a feedback mechanism to provide a controlled braking force in response to changes in tape tension.

EXAMPLE

Using one of the dispensers 104 shown in FIG. 2, tape was dispensed from a first spool on the upper spindle 106 of the dispenser at a rate of about 1200 feet per minute. When the first spool was depleted of the tape, tape was dispensed from a second spool on the lower spindle 108 at a rate of about 1200 feet per minute. Both spools had approximately 27,000 feet of tape, and had an initial radius of about 6.5" and a final radius of about 1.8".

Figure 8A:
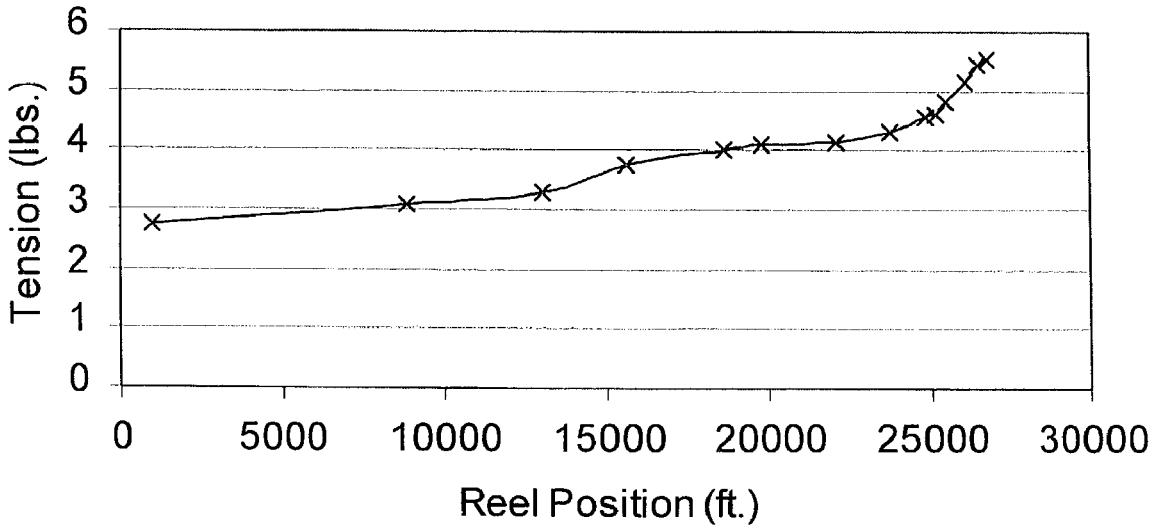
FIGS. 8A and 8B are graphs illustrating the tension in tape being dispensed from an upper spindle (FIG. 8A) and a lower spindle (FIG. 8B).
Figure 8B:
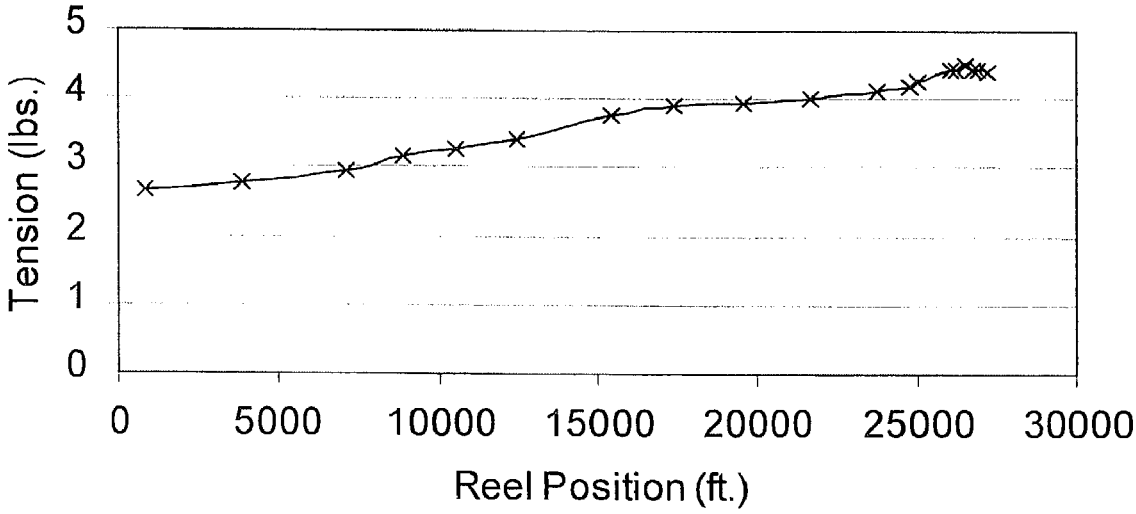

FIGS. 8A and 8B illustrate the operation of the feedback system as tape is dispensed from the first spool (FIG. 8A) and the second spool (FIG. 8B). Tension (measured in lbs.) in the tape path is plotted along the y-axes in FIGS. 8A and 8B. The amount of tape (in feet) removed from the first and second spools is plotted along the x-axes in FIGS. 8A and 8B, respectively. As shown in FIG. 8A, the tension in the tape path increased from about 2.74 lbs. near the beginning of the first spool to about 5.55 lbs. near the end of the first spool. As shown in FIG. 8B, the tension in the tape path increased from about 2.65 lbs. near the beginning of the second spool to about 4.45 lbs. near the end of the second spool.

Comparatively, if the tape was dispensed from a similar system without a brake being operatively connected to a tension-control mechanism in a feedback system, the tension in the tape paths would have increased in proportion to the change in the radii of the spools. For example, a tape path being dispensed from the first spool, having an initial tension of 2.74 lbs., would have increased to about 10 lbs. near the end of the spool (2.74 lbs.×6.5"/1.8").

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

I claim:

1. An apparatus for dispensing elongated material from a roll of material, comprising:

at least one spindle for supporting the roll of material;

a brake for applying a braking force to the at least one spindle;

a movable guide member for defining a portion of the path the elongated material is to follow, the guide member being movable in response to increased tension in the material to shorten the path of the material and movable in response to decreased tension in the material to lengthen the path of the material;

a pivoted lever; and an elongated biasing member coupled at one end to the guide member such that the guide member applies a force to the biasing member corresponding to the tension in the material, the biasing member being movably coupled to the lever and configured to apply a force to the lever corresponding to the tension in the material in response to movement of the guide member, wherein the force applied to the lever by the biasing member is greater than the force that the guide member applies to the biasing member;

wherein the lever and the brake cooperate to reduce the braking force when the movable guide member moves to shorten the path length of the material and to increase the braking force when the guide member moves to lengthen the path length.

2. The apparatus of claim 1, wherein the biasing member comprises an elastic member.

3. The apparatus of claim 1, wherein the guide member is mounted for movement on a rail, the guide member having a pulley around which the material is reeved so that an increase or decrease in tension in the material causes movement of the guide member.

4. The apparatus of claim 1, wherein the brake comprises:

a brake band extending at least partially around the spindle; and a spring coupled to the brake band and configured to urge the brake band against the spindle.

5. The apparatus of claim 4, wherein the spring is a compression spring and the apparatus further comprises a stop mechanism configured to limit compression of the spring.

6. The apparatus of claim 4, wherein:

the biasing member comprises an elastic member; and the spring is a compression spring and the apparatus further comprises a stop mechanism configured to limit compression of the spring.

7. The apparatus of claim 1, wherein the at least one spindle comprises a first spindle for supporting a first roll of material and a second spindle for supporting a second roll of material.

8. The apparatus of claim 7, wherein the brake comprises a brake band extending at least partially around the first and second spindles.

9. The apparatus of claim 1, wherein the roll of material is a roll of tape.

10. An apparatus for dispensing elongated material from a roll of material, comprising:

at least one spindle for rotatably supporting the roll of material;

a brake for applying a braking force to the at least one spindle;

a mechanical linkage coupled to the brake;

a pulley disposed on the mechanical linkage;

a tension-control mechanism coupled to the material as the material is being dispensed, the tension-control mechanism being movable in a first direction in response to an increase in tension in the material being dispensed; and a biasing member reeved around the pulley and having a first end coupled to the tension-control mechanism and a second end secured at a position spaced from the mechanical linkage, the biasing member providing a biasing force for urging the tension-control mechanism in a second direction whenever there is a decrease in tension in the material being dispensed;

wherein the mechanical linkage, the brake, the tension-control mechanism, and the biasing member cooperate to vary the braking force in response to changes in tension in the material.

11. The apparatus of claim 10, wherein the biasing member comprises an elongate piece of elastic material.

12. The apparatus of claim 11, wherein the elongate piece of elastic material comprises surgical tubing.

13. The apparatus of claim 10, wherein the brake comprises a compression spring for exerting a biasing force to retard rotation of the spindle and a stop mechanism that limits compression of the spring.

14. The apparatus of claim 10, wherein:

the at least one spindle comprises a first spindle for supporting a first roll of material and a second spindle for supporting a second roll of material, wherein a leading end portion of the second roll of material may be spliced to a trailing end portion of said first roll of material; and the brake is configured to prevent over-acceleration of the second roll of material after the trailing end portion of the first roll is spliced to the leading end portion of the second roll while dispensing material from the second roll at a rate of at least 900 feet per minute.

15. An apparatus for dispensing elongated material from a roll of material, comprising:

at least one spindle for supporting the roll of material;

a brake for applying a braking force to the at least one spindle;

a movable guide member for defining a portion of the path the elongated material is to follow, the guide member being movable in response to increased tension in the material to shorten the path of the material and movable in response to decreased tension in the material to lengthen the path of the material;

a pivoted lever; and an elongated biasing member coupled at one end to the guide member, the biasing member being movably coupled to the lever and configured to apply a force to the lever corresponding to the tension in the material in response to movement of the guide member;

wherein the lever and the brake cooperate to reduce the braking force when the movable guide member moves to shorten the path length of the material and to increase the braking force when the guide member moves to lengthen the path length;

wherein:

the lever includes a pulley; and the biasing member is flexible and is reeved around the pulley and has one end coupled to the guide member and another end secured at a position spaced from the lever.

16. An apparatus for dispensing elongated material from a roll of material, comprising:

at least one spindle for supporting the roll of material;

a brake for applying a braking force to the at least one spindle;

a movable guide member for defining a portion of the path the elongated material is to follow, the guide member being movable in response to increased tension in the material to shorten the path of the material and movable in response to decreased tension in the material to lengthen the path of the material;

a pivoted lever; and an elongated biasing member coupled at one end to the guide member, the biasing member being movably coupled to the lever and configured to apply a force to the lever corresponding to the tension in the material in response to movement of the guide member;

wherein the lever and the brake cooperate to reduce the braking force when the movable guide member moves to shorten the path length of the material and to increase the braking force when the guide member moves to lengthen the path length;

wherein the brake comprises a brake band extending at least partially around the spindle, and a spring coupled to the brake band and configured to urge the brake band against the spindle;

wherein the spring is a compression spring and the apparatus further comprises a stop mechanism configured to limit compression of the spring;

wherein the stop mechanism comprises:

a rigid sleeve disposed around a portion of the spring; and a washer coupled to an end of the spring extending outside of the sleeve and configured to contact the rigid sleeve, and therefore limit the compression of the spring.

17. An apparatus for dispensing elongated material from a roll of material supported on a rotatable spindle, comprising:

a tension-control mechanism for defining the path of the material being dispensed from the roll, the tension-control mechanism being movable in a first direction in response to an increase in tension in the material being dispensed;

at least one pulley;

an elongated elastic member reeved around the pulley and having a first end coupled to the tension-control mechanism and a second end secured at a position spaced from the pulley, the elastic member providing a biasing force for urging the tension-control mechanism in a second direction whenever there is a decrease in tension in the material being dispensed;

a brake for applying a braking force to the spindle, the brake being operatively coupled to the elastic member such that the brake increases the braking force on the spindle whenever there is a decrease in tension in the material being dispensed and decreases the braking force on the spindle whenever there is an increase in tension in the material being dispensed; and a pivotable lever having a first end portion and a second end portion, the pulley being disposed on the first end portion of the lever; and a connecting member coupled at one end to the second end portion of the lever and coupled at another end to the brake.

18. An apparatus for dispensing tape from a first roll of tape and then from a second roll of tape, wherein the trailing end portion of the first roll is spliced to the leading end portion of the second roll to provide a continuous feed of tape, the apparatus comprising:

a first rotatable spindle for supporting the first roll of tape;

a second rotatable spindle for supporting the second roll of tape;

a feedback mechanism configured to prevent slack from forming in the second roll of tape following splicing as tape from the second roll is being dispensed at a rate of at least 900 feet per minute;

wherein the feedback mechanism comprises:

a brake mechanism for applying a braking torque to the first and second spindles;

a mechanical linkage coupled to the brake mechanism;

a tension-control mechanism operable to move in response to changes in tension in tape dispensed from the first and second rolls;

a biasing element coupling the tension-control mechanism to the mechanical linkage; and a pulley disposed on the mechanical linkage, and wherein the biasing element comprises an elastic member connected to the tension-control mechanism and reeved around the pulley.

19. An apparatus for dispensing elongated material from first and second rolls of the material, comprising:

a first spindle for supporting the first roll of material;

a second spindle for supporting the second roll of material;

an elongated rail;

a guide member mounted for movement along the rail for defining a portion of the path the elongated material is to follow, the guide member being movable in response to increased tension in the material to shorten the path of the material and movable in response to decreased tension in the material to lengthen the path of the material;

a brake for applying a braking force to the first and second spindles, the brake comprising a brake band extending at least partially around the first and second spindles;

a pivoted lever coupled to the brake band;

a pulley disposed on the lever; and an elongated elastic member having first and second ends and being reeved around the pulley, the first end of the elastic member being connected to the guide member and the second end being secured at a position spaced from the pulley;

wherein the lever, the brake, the guide member, and the elastic member cooperate to provide a feedback mechanism to automatically adjust the braking force in response to changes in tension in the material being dispensed.

* * * * *